US006126475A

United States Patent [19]

Matsuura et al.

[11] Patent Number: 6,126,475

[45] **Date of Patent: *Oct. 3, 2000**

[54] CONNECTOR HAVING GUIDE BUSH WITH ENHANCED GROUND CONTACT

[75] Inventors: Naoya Matsuura, Yokohama; Tomonari Kaneko; Yoshikazu Ito, both of Yamato, all of Japan

[73] Assignee: Molex Incorporated, Lisle, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 09/034,195

[22] Filed: Mar. 3, 1998

[30] Foreign Application Priority Data

Mar. 3, 1997 [JP] Japan ..... 9-063755

[51] Int. Cl.[7] ..... H01R 13/64

[52] U.S. Cl. ..... 439/381; 435/374

[58] Field of Search ..... 439/374, 376, 439/377, 378, 379, 380, 381

[56] References Cited

U.S. PATENT DOCUMENTS

| | | | |
|---|---|---|---|
| D. 332,598 | 1/1993 | Kikuta et al. . | |
| 3,059,208 | 10/1962 | Concelman | 439/381 |
| 3,091,748 | 5/1963 | Takes et al. | 439/381 |
| 3,718,885 | 2/1973 | Dorjee et al. | 439/381 |
| 3,930,705 | 1/1976 | Gallagher | 439/378 |
| 4,171,861 | 10/1979 | Hohorst . | |
| 4,682,412 | 7/1987 | Pfeffer . | |
| 4,902,242 | 2/1990 | Davis et al. . | |
| 5,059,139 | 10/1991 | Spinner . | |
| 5,098,312 | 3/1992 | Raczynski . | |
| 5,232,382 | 8/1993 | Karlovich | 439/81 |
| 5,266,057 | 11/1993 | Angel, Jr. et al. . | |
| 5,288,244 | 2/1994 | Lien . | |
| 5,340,329 | 8/1994 | Hirai . | |
| 5,490,789 | 2/1996 | Simons | 439/101 |
| 5,529,517 | 6/1996 | Hopf et al. | 439/843 |

FOREIGN PATENT DOCUMENTS

| | | |
|---|---|---|
| 0 720 254 A2 | 7/1996 | European Pat. Off. . |
| 60-181871 | 5/1984 | Japan . |
| 60-181871 | 12/1985 | Japan . |
| 4-324272 | 4/1991 | Japan . |
| 4-324272 | 11/1992 | Japan . |
| 6-140096 | 5/1994 | Japan . |
| 2 076 492 | 12/1981 | United Kingdom . |

*Primary Examiner*—Lincoln Donovan
*Attorney, Agent, or Firm*—Charles S. Cohen; Robert J. Zeitler

[57] ABSTRACT

An electrical connector and guide bush therefor wherein the guide bush is mounted upon the front of the electrical connector into an aperture in the front face and wherein a shield is mounted onto the front face. The guide bush receives therein a guide pin from a mating electronic component. The guide bush includes an integral body having a head portion and a tail portion. The tail portion may be retainably inserted into the aperture in the front face. The head portion has a bore therein for receiving the guide pin from the mating electronic component. At least one resilient contact member protrudes into the bore for contacting the guide pin of the mating component when the guide pin is received in the bush. The contact established thereby creates a ground circuit therethrough.

30 Claims, 5 Drawing Sheets

CONNECTOR HAVING GUIDE BUSH WITH ENHANCED GROUND CONTACT

BACKGROUND OF THE INVENTION

The present invention relates to an electrical connector having guide bushes, and more particularly to a connector having guide bushes with enhanced ground contacts.

It is well known that particular electrical connectors, particularly input/output ("I/O") connectors, may be fitted with guide bushes on their application surfaces (front faces) for receiving corresponding guide pins of a complementary electrical connector. By providing guide holes in the guide bushes for the corresponding pins, proper alignment is more easily achieved between the mating connectors. An example of such an input/output electrical connector is disclosed in Japanese Patent Application Laid-Open No. 6-140096.

A typical I/O electrical connector includes a dielectric housing having a front face and a mating portion projecting forwardly from the front face, a plurality of terminals mounted in a complementary mating portion of the housing for engaging complementary terminals in the mating connector during mating, and a conductive shield on the front face of the housing, the shield generally including a shroud encircling the mating portion and linear arrangement of the terminals and a flange integrally formed with the shroud for overlying much or all of the front face of the connector. The shields of the mating connectors preferably engage and maintain electrical contact upon mating, and will thereby be kept at ground or at least the same potential.

Typically, an internally threaded cylindrical bore extends through the flange and front face on either side of the shroud to provide a pair of recesses into which externally threaded guide bushes may be mounted. Generally, guide bushes have a relatively narrow externally threaded tail sections for screwing into the internally threaded recesses as well as a relatively wider head section for mounting flush to the front face and projecting forwardly from the front face to provide enhanced mating capability, as described above, with a corresponding electrical connector or other electronic device.

Because of the structure of the shield and the manner in which it is mounted on the housing, significant wearing and/or deformation may occur, thereby weakening or inhibiting the electrical contact between the opposing shields and making the ground potential unstable.

SUMMARY OF THE INVENTION

The present invention provides an electrical connector having guide bushes with an enhanced grounding capability.

Disclosed herein is an electrical connector and a guide bush for mounting upon a front face of the electrical connector wherein the front face has an aperture therein and a shield mounted thereon. The guide bush is adapted for mounting into the aperture on the front face and for receiving therein a guide pin from a mating electronic component. The guide bush includes an integral body having a head portion and a tail portion, the tail portion being inserted into the aperture, and the head portion having a bore therein for receiving the guide pin from the mating electronic component. A resilient contact member protrudes into the bore for contacting the guide pin of the mating component when the guide pin is received in the guide bush in order to establish a ground circuit therethrough.

In this manner, the maintenance of the ground potential is assured, even if wearing or deformation causes the contact between mating shields to be unreliable for this purpose. Other advantages of the present invention will be more clearly understood from the following description of the preferred embodiment(s) of the invention.

DESCRIPTION OF THE PREFERRED EMBODIMENT

Figure 1:
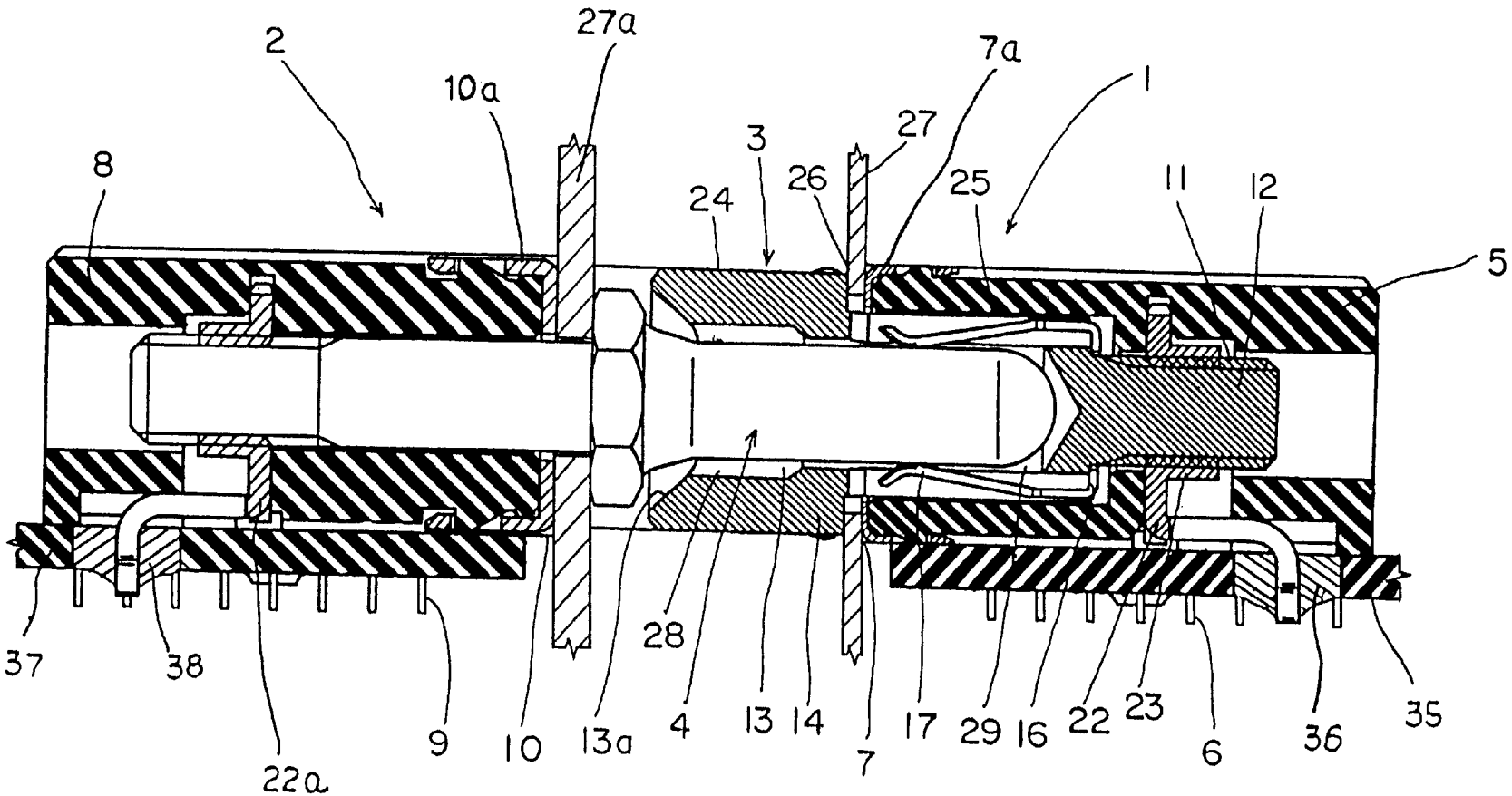
FIG. 1 is a cross-sectional view of an electrical connector and guide bush in accordance with the invention wherein the guide bush is shown mated with a guide pin from a mating connector.

Referring to FIG. 1, an electrical connector 1 having a metal conductive guide bush 3 according to the present invention is shown mated with an electrical connector 2 having a metal conductive guide pin 4. The guide-bushed electrical connector 1 has guide bushes 3 on opposite ends of its application or front surfaces 7 for accommodating the guide pins 4 projecting from the opposite ends of the application surface of the guide-pinned electrical connector 2, thereby guiding the mating of the correspondingly fitting electrical connector 2 by guiding pins 4 into the guide bushes 3 of the guide-bushed electrical connector 1. The dielectric housing 5 of the guide-bushed electrical connector 1 has a mating portion 34 (FIG. 5) having a plurality of terminals 6 arranged and fixed in parallel lines therein, the terminals being directed toward the application surface 7 of the dielectric housing 5 (only their tails are shown in FIG. 1). Two guide bushes 3 are arranged at opposite ends of the mating portion.

Likewise, the dielectric housing 8 of the guide-pinned electrical connector 2 has a mating portion having a plurality of terminals 9 arranged and fixed in parallel lines therein, these terminals being directed to the application surface 10 of the dielectric housing 8 (again, only their tails are shown in FIG. 1). Two guide pins 4 are arranged at opposite ends of the parallel terminal arrangement so that these guide pins 4 may be aligned with the guide bushes 3 of the guide-bushed electrical connector 1 upon mating.

A metal shield 7*a* is applied to the front face (application surface 7 of the dielectric housing 5 excluding the mating portion/ terminal arrangement) of the guide-bushed electrical connector 1, and a metal shield 10*a* is applied to the front face of the dielectric housing 8 excluding the terminal arrangement of the guide-pinned electrical connector 2. The shields 7*a* and 10*a* have forwardly protruding shroud sections surrounding the mating portions, and the protruding shroud sections of the shields 7*a* and 10*a* telescope one another when the connectors 1 and 2 are mated.

Referring to FIGS. 2–8, each guide bush 3 is preferably metal, and comprises a fixing part 12 having threads 11 on its outer circumference and a hollow cylindrical part 14 having a guide hole 13 along its central axis for accommodating a guide pin 4 of the electrical connector 2. The hollow cylindrical part 14 has a pair of diametrically opposed slots 15 formed in the circumferential wall of the hollow cylindrical part 14, and contact members 16 are fixed to the guide bush adjacent the fixing part 12 so that their resilient contact legs 17 protrude into the guide hole 13.

Figure 13:
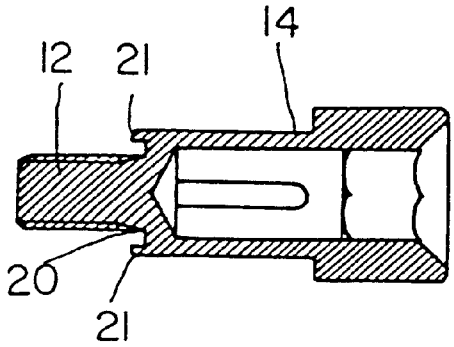
FIG. 13 is a cross-sectional view of the guide bush of FIG. 2 prior to attaching a contact member.

Referring to FIGS. 9–12, the contact member 16 is preferably stamped of sheet metal and comprises a generally annular base 18 having a pair of resilient contact legs 17 integrally connected thereto standing diametrically opposed with one another. The circular hole 19 of the annular base 18 is sized to allow the fixing part 12 to pass therethrough. As seen from FIG. 13, a step-like transition 20 from the fixing part 12 to the cylindrical part 14 has projections 21 formed on the cylindrical circumference of the cylindrical part 14. After inserting the fixing part 12 of the guide bush 3 into the circular hole 19 of the annular base 18 of the resilient contact 16, the projections 21 are bent or otherwise deformed on the annular base 18 as seen from FIG. 8. This bending positively fixes the contact member 16 to the fixing part 12 of the guide bush 3, allowing its contact legs 17 to pass through the slots 15 and partly protrude into the guide hole 13.

As best seen from FIG. 1, the dielectric housing 5 of the connector 1 preferably has grounding members 22 fixed therein. Each grounding member 22 has a tapped or threaded receptacle 23. The guide bush 3 can be fixed to the dielectric housing 5 by threadedly engaging its fixing part 12 in the tapped receptacle 23, with the diverging inlet 13*a* opening on the side of the application surface 7 of the dielectric housing 5.

Figure 2:
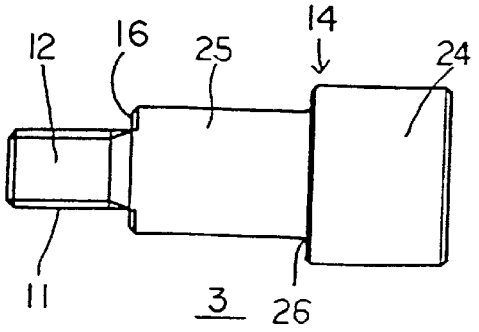
FIG. 2 is a side elevational view of one of the guide bushes of the electrical connector of FIG. 1.
Figure 5:
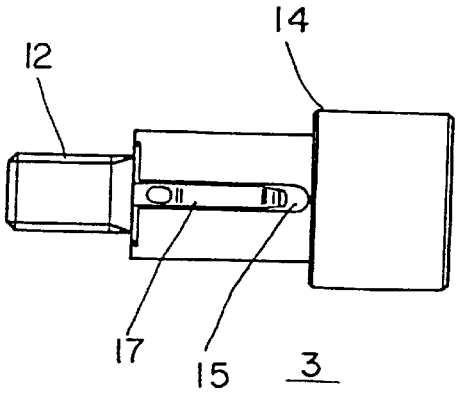
FIG. 5 is a top plan view of the guide bush of FIG. 2.

As best seen in FIGS. 2 and 5, the hollow cylindrical part 14 has a step-like transition from the relatively larger head 24 to the relatively smaller trunk 25. In use, the connector 1 will be mounted adjacent a metal panel 27 having holes for the guide bushes 3 and the mating portion 34 and then the guide bushes are screwed into the tapped receptacle. As such, the panel 27 is sandwiched between the step-like transition and the front surface 7 of the shield 7*a*. Thus, the guide-bushed electrical connector 1 is fixed to the panel 27, and the grounding receptacle 22 is soldered to the ground circuit of the printed circuit board 35 at 36. Likewise, the guide-pinned electrical connector 2 preferably has grounding members 22*a* fixed therein, and the guide pins 4 are threadedly engaged with the grounding members 22*a*, which are, in turn, soldered to the ground circuit of the printed circuit board 37 at 38.

Figure 3:
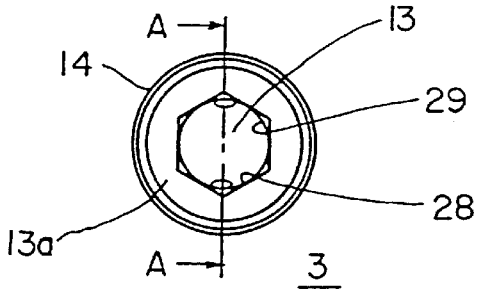
FIG. 3 is a front elevational view of the guide bush of FIG. 2.
Figure 4:
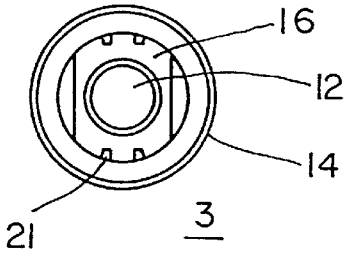
FIG. 4 is a rear elevational view of the guide bush of FIG. 2.
Figure 6:
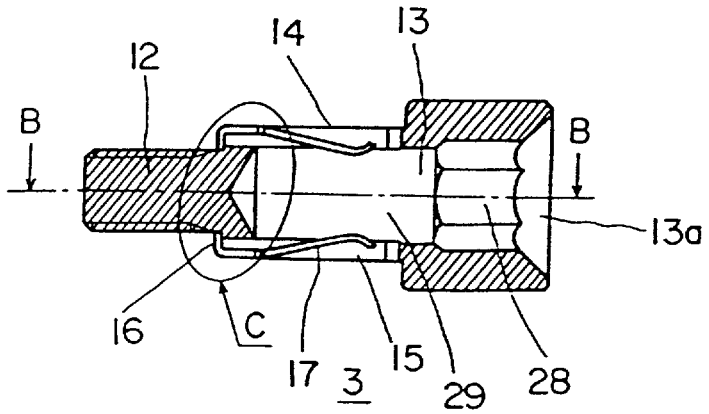
FIG. 6 is a cross-sectional view of the guide bush of FIG. 3 taken along the line A—A.
Figure 7:
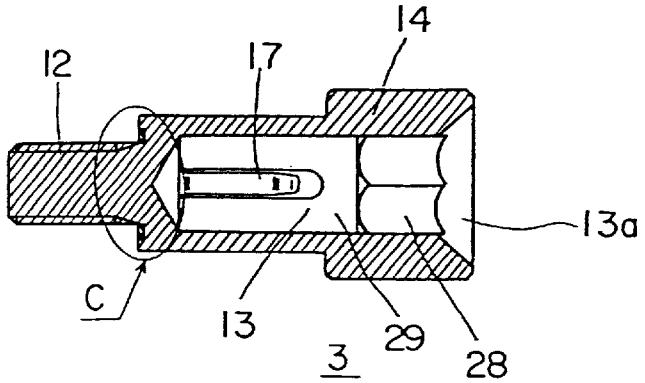
FIG. 7 is a cross-sectional view of the guide bush taken along the line B—B of FIG. 6.
Figure 8:
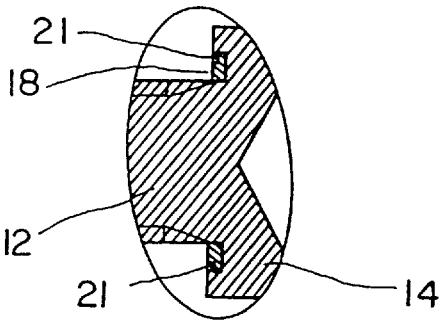
FIG. 8 is an enlarged view of the encircled area in FIG. 6.
Figure 9:
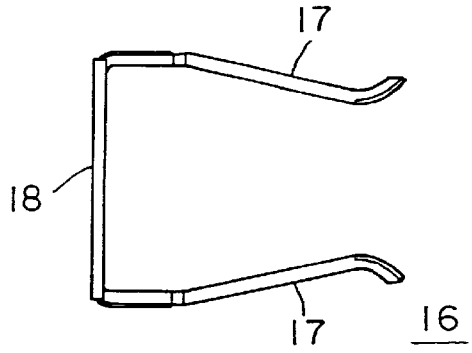
FIG. 9 is a side elevational view of a contact member for enhancing the ground contact.
Figure 10:
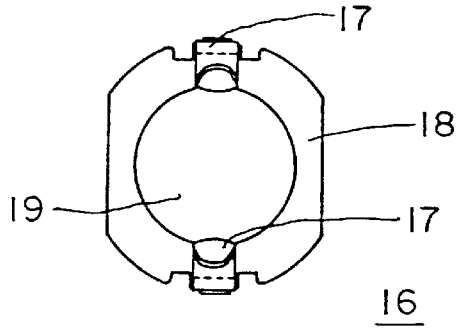
FIG. 10 is a front elevational view of the contact member of FIG. 9.
Figure 11:
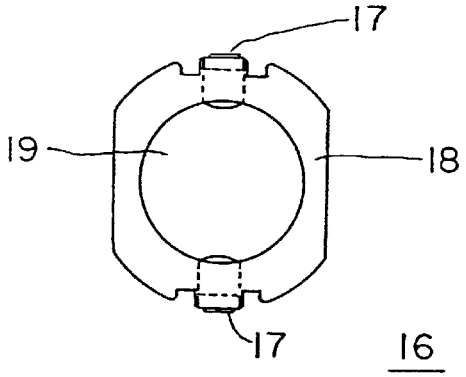
FIG. 11 is a rear elevational view of the contact member of FIG. 9.
Figure 12:
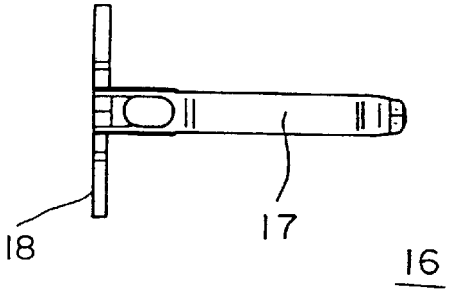
FIG. 12 is a top plan view of the contact member of FIG. 9.

Referring to FIGS. 6 and 7, the guide hole 13 of the guide bush includes a hexagonal hole 28 and a substantially aligned round hole 29 generally contiguous to the hexagonal hole 28. As best seen in FIG. 3, the circular perimeter of the round hole 29 is inscribed within the hexagonal hole 28 when viewed along the central axis of the guide hole 13. The inscribed circle has substantially the same width as does the guide pin 4 of the mating connector 2, thereby permitting the guide pin 4 to be inserted into the hollow cylindrical part 14 and be guided along the center axis of the hollow cylindrical part 14 thereby.

As seen from FIG. 1, the guide-bushed electrical connector 1 can be mated with the guide-pinned electrical connector 2 by inserting the guide pins 4 into the guide holes 13 of the guide bushes 3 until the tips of the guide pins 4 are generally adjacent the bottoms of the round hole sections 29. At that point, the resilient contact legs 17 of the contact member 16 make contact with the guide pins 4, thereby establishing electrical connection between the guide bushes 3 and the guide pins 4. As a result, the shield 7*a* covering the application surface 7 of the dielectric housing 5 is conductively connected to the shield 10*a* covering the application surface 10 of the dielectric housing 8 of the complementary electrical connector 2. Thus, the ground circuit includes both shields 7*a* and 10*a* as well as the printed circuit board 35. The use of the ground contact members 16 contacting the guide pins 4 provides a more reliable contact than just establishing the ground circuit between shields 7*a* and 10*a*. This provides the enhanced grounding effect.

The guide pins 4 are insertable and removable freely in the hexagonal and round hollow space of the guide hole 13 and are not therefore subject to significant deformation. When the invading pins 4 meet the resilient contact legs 17, the legs resiliently flex against the insertion force but maintain contact with the guide pin 4 under a biased force. Repeated mating of the guide pin and guide bush will have no significant adverse effect on the ground circuit due to the resilience of the contact legs 17, thereby assuring a stable ground interconnection each time the connectors are mated.

Two or more contact members 16 may be used, and individual contact members 16 may have more than two contact legs 17 thereon. The contact legs 17 may preferably be arranged symmetrically with respect to the center axis of the guide hole 13. Of course, the slots 15 are made in the cylindrical wall 14 of the guide bush 3 to provide the proper spacing for the contact legs 17 around the center of the guide hole 13. Preferably, the slots 15 are also arranged symmetrically with respect to the center of the guide hole 13.

Figure 14:
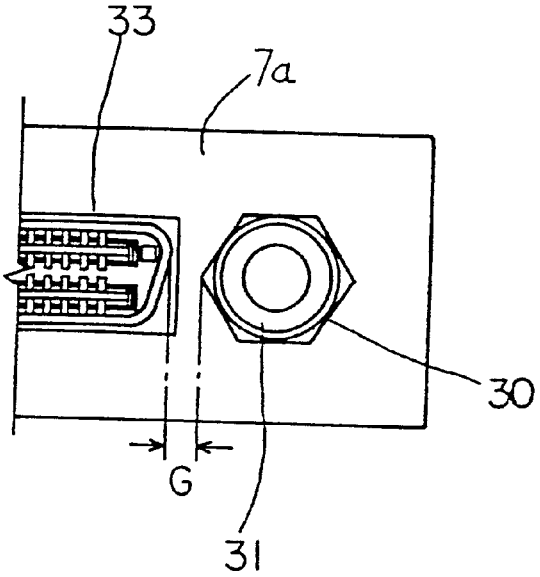
Figure 14 Prior Art
FIG. 14 is a fragmented front view of a prior art electrical connector having a guide bush.

The hexagonal hole shape 28 of the inlet section of the guide bush 3 helps reduce the width of the electrical connector 1. As seen in FIG. 14, a conventional guide bush 30 has an inlet outer perimeter of hexagonal shape 31. Affixing such a guide bush 30 to the dielectric housing 32 typically employs a wrench or box-like driver applied to the outer perimeter of the hexagonal head 31 of the bush 30 to rotate the head 31 onto the housing 32. In order to apply the circumscribing tool there must be a gap G between the bush 30 and the end of the linear terminal contact arrangement 33 or mating portion (often a protruding shield shroud), wherein gap G is sufficiently large to allow the insertion of at least a portion of the wrench or other circumscribing tool therebetween. Accordingly, the lateral sides of the electrical connector must be increased in order to account for the additional width of the circumscribing tool.

Figure 15:
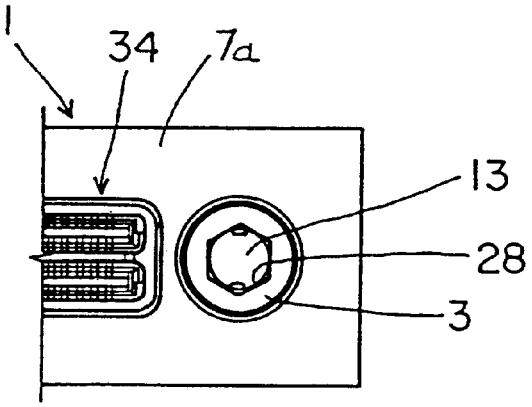
FIG. 15 is a fragmented front view of an electrical connector having an enhanced ground contact guide bush in accordance with the present invention.

For the described embodiment, the guide bush structure avoids such a problem by allowing insertion of a hexagonal rod-like tool or shaft into the guide hole 13 for rotationally engaging the guide bush 3 with the ground peg 22. Thus, the additional space required for the circumferential tool in the conventional connector is not required. As seen in FIG. 15, the guide bush 3 may be located very closely to the end of the mating portion, thus permitting a reduction in the lateral size of the electrical connector. Of course, the inlet to the guide hole may take triangular, rectangular, pentagonal, or many other possible shapes. The hexagonal shape is preferable due to its availability as an insertion tool.

The invention, as appreciable from the foregoing description of the various embodiments, provides significant advantages over conventional connectors, particularly with regard to enhancing the ground contact between the mating connectors. The invention is not limited to the preferred embodiment described herein, or to any particular embodiment. Specific examples of alternative embodiments considered to be within the scope of the invention, without limitation, include embodiments wherein there are fewer or more contact legs to enhance the ground contact, wherein such contact legs are spaced alternatively from the described embodiments, even in asymmetrical patterns, wherein the hexagonal inlet opening 28 is not present, wherein the shield shroud surrounding the linear terminal contact arrangement is substantially rectangular, trapezoidal, or of any other shape, and wherein the outer perimeter of the guide bush is round, hexagonal, or any other shape. Other modifications to the described embodiments may also be made within the scope of the invention. The invention is defined by the following claims.

What is claimed is:

1. A conductive guide bush for mounting upon a front face of an electrical connector into an appropriately configured aperture in said front face, said guide bush being adapted to receive therein a guide pin from a mating electronic component, said guide bush comprising:

an integral body having a head portion and a tail portion, said tail portion being adapted for retainable insertion into said aperture of said connector;

a bore in an end of said integral body for receiving said guide pin from said mating electronic component;

at least one slot extending between an outer surface of said integral body and said bore; and at least one resilient contact member protruding into said bore through said at least one slot for contacting said guide pin of said mating component when said guide pin is received in said guide bush.

2. A conductive guide bush in accordance with claim 1 wherein said at least one resilient contact member is independent from said integral body.

3. A guide bush in accordance with claim 1 wherein said contact member includes at least one resilient contact leg for biasing against said guide pin when said guide pin is received in said guide bush.

4. A guide bush in accordance with claim 1 wherein said contact member includes at least two contact legs for contacting said guide pin when said guide pin is received in said guide bush.

5. A guide bush in accordance with claim 4 wherein said at least two contact legs are arranged symmetrically with respect to the center of said bore.

6. A guide bush in accordance with claim 1 wherein said head portion includes a head section of relatively larger diameter and a trunk section of relatively smaller diameter integrally connected to said head section to form a step-like transition, said step-like transition and said front face of said connector being adapted to sandwich a panel therebetween.

7. A conductive guide bush in accordance with claim 1 wherein said head portion includes a head section and a trunk section.

8. A conductive guide bush in accordance with claim 7 wherein said at least one slot is located in said trunk section.

9. A conductive guide bush in accordance with claim 8 wherein said at least one contact member includes a generally annular base having at least one resilient contact leg connected to said base.

10. A conductive guide bush in accordance with claim 9 wherein said base has an opening therein to allow said tail portion to pass through said base.

11. An electrical connector comprising:

a dielectric housing having a front face, said front face having an aperture therein;

a conductive guide bush mounted in said aperture, said guide bush being adapted to receive therein a guide pin from a mating electronic component;

said guide bush including an integral body having a head portion and a tail portion, said tail portion being inserted into said aperture;

a bore in said integral body for receiving said guide pin from said mating electronic component;

at least one slot extending between an outer surface of said integral body and said bore; and at least one resilient contact member protruding into said bore through said at least one slot for contacting said guide pin of said mating component when said guide pin is received in said guide bush.

12. An electrical connector in accordance with claim 11 wherein said contact member includes at least one resilient contact leg for biasing against said guide pin when said guide pin is received in said guide bush.

13. An electrical connector in accordance with claim 11 wherein said contact member includes at least two contact legs for contacting said guide pin when said guide pin is received in said guide bush.

14. An electrical connector in accordance with claim 13 wherein said at least two contact legs are arranged symmetrically with respect to the center of said bore.

15. An electrical connector in accordance with claim 11 wherein said head portion includes a head section of relatively larger diameter and a trunk section of relatively smaller diameter integrally connected to said head section to form a step-like transition, said steplike transition and said front face of said connector being adapted to sandwich a panel therebetween.

16. An electrical connector in accordance with claim 11 wherein said head portion includes a head section and a trunk section.

17. An electrical connector in accordance with claim 16 wherein said at least one slot is located in said trunk section.

18. An electrical connector in accordance with claim 17 wherein said at least one contact member includes a generally annular base having at least one resilient contact leg connected to said base.

19. An electrical connector in accordance with claim 18 wherein said base has an opening therein to allow said tail portion to pass through said base.

20. A conductive guide bush, said guide bush comprising:

an integral body having a head portion and a tail portion;

a bore in said integral body;

at least one slot extending between an outer surface of said integral body and said bore; and at least one resilient contact member protruding into said bore through said at least one slot.

21. A conductive guide bush in accordance with claim 20 wherein said head portion includes a head section and a trunk section.

22. A conductive guide bush in accordance with claim 21 wherein said at least one slot is located in said trunk section.

23. A conductive guide bush in accordance with claim 22 wherein said at least one contact member includes a generally annular base having at least one resilient contact leg connected to said base.

24. A conductive guide bush in accordance with claim 23 wherein said base has an opening therein to allow said tail portion to pass through said base.

25. A conductive guide bush in accordance with claim 20 wherein said at least one contact member includes at least two resilient contact legs.

26. A conductive guide bush in accordance with claim 25 wherein said at least two contact legs are arranged symmetrically with respect to the center of said bore.

27. A conductive guide bush in accordance with claim 21 wherein said diameter of said head section is larger than the diameter of said trunk section.

28. A conductive guide bush in accordance with claim 27 wherein said at least one slot is located in said trunk section.

29. A conductive guide bush in accordance with claim 28 wherein said at least one contact member includes a generally annular base having at least one resilient contact leg connected to said base.

30. A conductive guide bush in accordance with claim 29 wherein said base has an opening therein to allow said tail portion to pass through said base.

* * * * *